US011192677B2

(12) United States Patent
Kutsuzawa

(10) Patent No.: US 11,192,677 B2
(45) Date of Patent: Dec. 7, 2021

(54) DELAMINATION CONTAINER

(71) Applicant: YOSHINO KOGYOSHO CO., LTD., Tokyo (JP)

(72) Inventor: Shintaro Kutsuzawa, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 70 days.

(21) Appl. No.: 16/606,124

(22) PCT Filed: Mar. 2, 2018

(86) PCT No.: PCT/JP2018/008076
§ 371 (c)(1),
(2) Date: Oct. 17, 2019

(87) PCT Pub. No.: WO2018/198533
PCT Pub. Date: Nov. 1, 2018

(65) Prior Publication Data

US 2020/0039678 A1 Feb. 6, 2020

(30) Foreign Application Priority Data

Apr. 28, 2017 (JP) ..... JP2017-090704

(51) Int. Cl.
*B65D 1/02* (2006.01)
*B65D 83/00* (2006.01)
(Continued)

(52) U.S. Cl.
CPC ..... *B65D 1/0215* (2013.01); *B65D 1/023* (2013.01); *B65D 1/0276* (2013.01); *B65D 23/02* (2013.01);
(Continued)

(58) Field of Classification Search
CPC .. B65D 1/0215; B65D 79/005; B65D 79/008; B65D 79/0084; B65D 77/06;
(Continued)

(56) References Cited

U.S. PATENT DOCUMENTS 5,301,838 A * 4/1994 Schmidt ..... B67D 1/0462 222/105
5,435,452 A * 7/1995 Nishigami ..... B05B 11/00412 215/12.1
(Continued)

FOREIGN PATENT DOCUMENTS

JP H04-339759 A 11/1992
JP 2007-091291 A 4/2007
(Continued)

OTHER PUBLICATIONS

Jul. 21, 2020 Office Action issued in Chinese Patent Application No. 201880026527.8.
(Continued)

*Primary Examiner* — James N Smalley
*Assistant Examiner* — Jennifer Castriotta
(74) *Attorney, Agent, or Firm* — Oliff PLC

(57) ABSTRACT

A delamination container includes a bottle-shaped outer layer body including a mouth, a barrel and a bottom and an inner layer body releasably laminated on an inner surface of the outer layer body, the mouth being provided with an ambient air introduction hole passing through the outer layer body, in which a lower portion of the mouth is provided with a neck ring which has a notch circumferentially outside of at least a portion immediately below the ambient air introduction hole; and the notch is provided within a range of 60° on both sides of a radial reference line passing through an axial center of the ambient air introduction hole and radially extending, in a planar view of the container.

14 Claims, 6 Drawing Sheets

(51) Int. Cl.
*B65D 23/02* (2006.01)
*B65D 79/00* (2006.01)

(52) U.S. Cl.
CPC ..... *B65D 79/005* (2013.01); *B65D 79/0084* (2020.05); *B65D 83/0055* (2013.01); *B65D 2501/0027* (2013.01)

(58) Field of Classification Search
CPC .. B65D 77/225; B65D 23/02; B65D 83/0055; B65D 83/0061; B65D 1/023; B65D 2501/0027
USPC ..... 220/495.04
See application file for complete search history.

(56) References Cited

U.S. PATENT DOCUMENTS 6,266,943 B1 * 7/2001 Nomoto ..... G01F 11/028 53/410
9,352,897 B2 * 5/2016 Hoshino ..... B65D 83/48
2003/0226856 A1 * 12/2003 Nakamura ..... B65D 25/16 222/105
2004/0060889 A1 * 4/2004 Yoneyama ..... B65D 1/0215 215/12.1
2008/0302757 A1 * 12/2008 Furusawa ..... B65D 1/0276 215/373
2015/0298890 A1 * 10/2015 Miyairi ..... B65D 83/0055 215/12.1

FOREIGN PATENT DOCUMENTS

JP 2007-290746 A 11/2007
JP 2012-096815 A 5/2012
JP 2014-091537 A 5/2014
JP 2017-114555 A 6/2017

OTHER PUBLICATIONS

Oct. 29, 2019 International Preliminary Report on Patentability issued in International Patent Application No. PCT/JP2018/008076.
Dec. 8, 2020 Office Action issued in Japanese Patent Application No. 2017-090704.
Apr. 17, 2018 International Search Report issued in International Patent Application No. PCT/JP2018/008076.
Jan. 7, 2021 Office Action issued in Chinese Patent Application No. 201880026527.8.
Feb. 8, 2021 Office Action issued in Korean Patent Application No. 10-2019-7030320.
May 11, 2021 Office Action issued in Japanese Patent Application No. 2017-090704.

* cited by examiner

DELAMINATION CONTAINER

TECHNICAL FIELD

The present disclosure relates to a delamination container in which an inner layer body configured to be deformed to undergo volume reduction is releasably laminated on an inner surface of a bottle-shaped outer layer body, and particularly relates to a delamination container in which an ambient air introduction hole continuing between the outer layer body and the inner layer body is provided to a mouth.

BACKGROUND

As a container that contains toiletries, examples of which including cosmetics such as face lotion, shampoo, rinse, liquid soap and the like, and seasoning such as soy source and the like as contents, a delamination container is known. The delamination container includes a bottle-shaped outer layer body and an inner layer body that is releasably laminated on an inner surface of the outer layer body and is configured to be deformed to undergo volume reduction, and a mouth of the delamination container is provided with an ambient air introduction hole passing through the outer layer body and continuing between the outer layer body and the inner layer body (see, for example, Patent Literature 1).

For example, a spout cap configured to include a check valve in a spout tube that dispenses contents and include a check valve in an opening communicating between an ambient air introduction hole and outside is fitted to a mouth of a delamination container. In the delamination container to which the above described spout cap is fitted, the contents can be dispensed by squeezing (pressing) a barrel thereof. On the other hand, when squeezing of the barrel is cancelled, the ambient air is introduced from the ambient air introduction hole into between the outer layer body and the inner layer body, and only the outer layer body can be restored to its original shape with the inner layer body deformed to undergo volume reduction, that is, without the contents replaced with the ambient air. In this manner, contact between the contents and the ambient air is suppressed, and as a result deterioration or change in quality of the contents contained in the container can be prevented.

CITATION LIST

Patent Literature

PTL 1: JP2007-290746A

SUMMARY

Technical Problem

In the delamination container configured in the above described manner, an inner layer body thereof is generally subjected to an initial release processing in the manufacturing process. The initial release processing of the inner layer body is performed by, after a delamination container is formed by blow molding, sucking the air out of the inner layer body from a mouth, or by blowing the air from the ambient air introduction hole into a space between the outer layer body and the inner layer body so as to once release the inner layer body from the outer layer body, and subsequently by supplying the air from the mouth into the inner layer body so as to return the inner layer body to the outer layer body side. In this manner, through the above described initial release processing, the inner layer body is easily released from the outer layer body, and as a result, when the outer layer body is restored to its original shape after the contents are dispensed, the inner layer body can be reliably released from the outer layer body.

However, in the existing delamination container, even if the inner layer body is subjected to an initial release processing, the inner layer body which has been released from the outer layer body and returned again to the outer layer body adheres to the inner surface of the outer layer body, and as a result an ambient air introduction channel extending from the ambient air introduction hole to the bottom side is not formed between the inner layer body and the outer layer body, which makes it difficult for the inner layer body to be released from the outer layer body.

The present disclosure is to solve the above described problem, and is to provide a delamination container in which the inner layer body is reliably released from the outer layer body when the outer layer body is restored to its original shape after the contents are dispensed, by reliably forming, through the initial release processing, an ambient air introduction channel extending between the inner layer body and the outer layer body from an ambient air introduction hole to the bottom side.

Solution to Problem

The disclosed delamination container is a delamination container having: a bottle-shaped outer layer body including a tubular mouth, a barrel continuing to the mouth and a bottom continuing to the barrel, the mouth being provided with an ambient air introduction hole passing through the outer layer body and continuing between the outer layer body and the inner layer body; and an inner layer body configured to be deformed to undergo volume reduction, the inner layer body being releasably laminated on an inner surface of the outer layer body and formed into a shape corresponding to the outer layer body, in which a lower portion of the mouth is provided with a neck ring;

the neck ring has a notch on a circumferential outside of at least a portion immediately below the ambient air introduction hole; and the notch is located within a range of 60° on each of both sides of a radial reference line passing through an axial center of the ambient air introduction hole and extending in a radial direction, in a planar view of the container.

In the disclosed delamination container, it is preferable that a pair of notches is provided, the notches being respectively located on both sides across an up and down reference line passing through the axial center of the ambient air introduction hole and extending in the up and down direction.

In the disclosed delamination container, it is preferable that at least one longitudinal rib is provided on a lower side of the ambient air introduction hole of the barrel.

In the disclosed delamination container, it is preferable that the longitudinal rib is provided on both sides across the up and down reference line passing through the axial center of the ambient air introduction hole and extending in the up and down direction.

In the disclosed delamination container, it is preferable that, viewed from an axial direction of the ambient air introduction hole, the longitudinal rib is provided on a position avoiding a virtual line passing through the axial center of the ambient air introduction hole and an end farthest away from the up and down reference line in the notch.

In the disclosed delamination container, it is preferable that the notch is located on both sides across at least a portion immediately below the ambient air introduction hole, and the longitudinal rib is provided inside a pair of the virtual lines across the up and down reference line.

In the disclosed delamination container, it is preferable that the barrel has a longitudinal adhesive band provided between the outer layer body and the inner layer body, and the notch is provided at a position that is circumferentially displaced with respect to an extension line of the adhesive band.

Advantageous Effect

According to the present disclosure, an ambient air introduction channel extending from an ambient air introduction hole to the bottom side is reliably formed between an inner layer body and an outer layer body through an initial release processing. In this manner, a delamination container in which the inner layer body is reliably released from the outer layer body when the outer layer body is restored to its original shape after the contents are dispensed can be provided.

DETAILED DESCRIPTION

The present disclosure will be described in more detail below with reference to the drawings.

Figure 1:
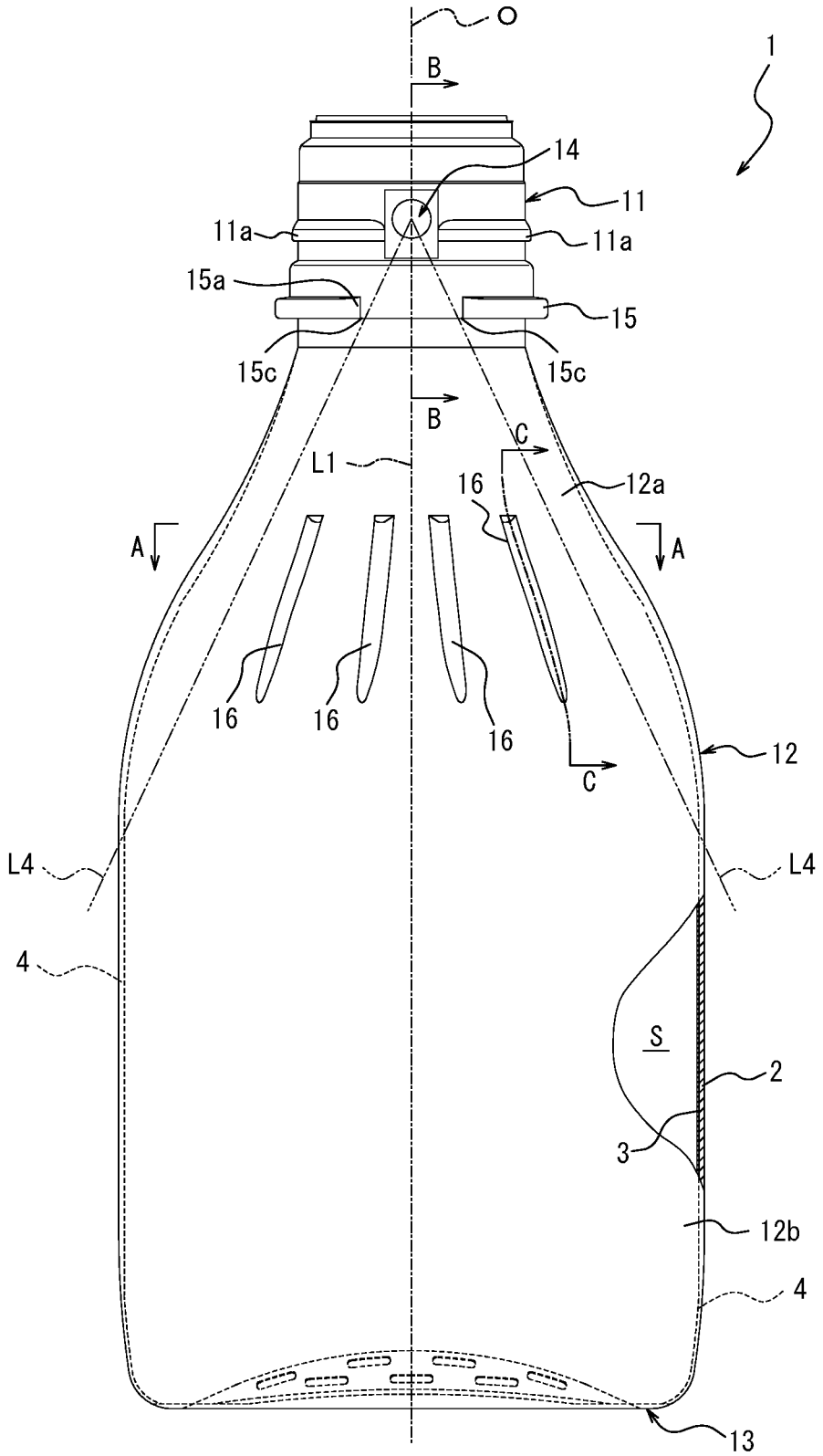
FIG. 1 is a side view of a delamination container according to an embodiment of the present disclosure.

It is to be noted that, in the specification, the claims and the abstract, the "up and down" direction refers to an up and down direction on the basis of the posture illustrated in FIG. 1. That is, "up" refers to upside in FIG. 1 and "down" refers to the opposite direction thereof.

As illustrated in FIG. 1, a delamination container 1 according to an embodiment of the present disclosure has a synthetic resin outer layer body 2 that forms an outer shell of the delamination container 1. The outer layer body 2 is formed into a bottle shape including a tubular (cylindrical in FIG. 1) mouth 11, a barrel 12 continuing to the mouth 11 and a bottom 13 continuing to the barrel 12. The barrel 12 has a substantially conical shoulder 12*a* continuing to the lower end of the mouth 11 and having a diameter that expands downward and a barrel body 12*b* continuing to the shoulder 12*a* and having a substantially constant outer diameter. The barrel 12 has a predetermined rigidity, can be dented when squeezed (pressed) and restored from a dented state to its original shape when squeezing is cancelled.

Inside the outer layer body 2 is provided with an inner layer body 3. The inner layer body 3 is formed from a synthetic resin material into a bag shape having a thickness smaller than that of the outer layer body 2, releasably laminated on the inner surface of the outer layer body 2, and has a shape corresponding to the shape of the outer layer body 2. Although not illustrated in detail, an opening of the inner layer body 3 is continued to an opening end of the mouth 11 of the outer layer body 2, and inside the inner layer body 3 has a space S continuing to the opening. Inside the inner layer body 3, that is, a space S, can contain contents in a liquid state such as, for example, toiletries, examples of which including cosmetics such as face lotion, shampoo, rinse, liquid soap and the like, and seasoning such as soy source and the like. The inner layer body 3 is configured to be deformed to undergo volume reduction. The inner layer body 3 is released from the inner surface of the outer layer body 2 as the contents are dispensed and can be deformed to undergo volume reduction so that the volume of the space S is reduced.

The above description of "the inner layer body 3 is releasably laminated on the inner surface of the outer layer body 2" means not only that the inner layer body 3 laminated on the inner surface of the outer layer body 2 through adhesion, pseudo-adhesion, or welding is released from the outer layer body 2, but also means that the inner layer body 3 laminated on the inner surface of the outer layer body 2 merely in an adhesive manner is released from the outer layer body 2.

In this embodiment, an adhesive band 4 disposed between the outer layer body 2 and the inner layer body 3 to adhere the outer layer body 2 and the inner layer body 3 to each other is provided to the barrel 12. The adhesive band 4 is an elongated longitudinal band extending from the mouth 11 to the bottom 13. The number of the adhesive bands 4 may be one, or two or more, as far as it is not disposed on a circumferential position of an ambient air introduction hole 14 described later. For example, two pieces of adhesive bands 4 may be provided across a parting line. Further, the adhesive band 4 may be provided only one side of the delamination container 1 in a circumferential direction, or it may be provided on two sides circumferentially opposed to each other. It is to be noted that the adhesive band 4 is not an essential component.

The delamination container 1 is formed into a lamination structure in which the inner layer body 3 is releasably laminated on the inner surface of the outer layer body 2 by coextruding a synthetic resin material for outer layer body and a synthetic resin material for inner layer body each having low compatibility with each other to form a laminated parison, and by blow molding the laminated parison with a mold. It is to be noted that the delamination container 1 may also be formed by biaxial stretching blow molding of a laminated preform formed in advance by injection molding or the like.

A spout tool (not illustrated) such as a spout cap is fitted to the mouth 11 by plugging, the spout cap being provided with a check valve at a spout tube that dispenses contents. The contents are dispensed through the spout tool. In the above described delamination container 1, when the spout cap configured in the above described manner is fitted to the mouth 11, the contents are dispensed from the mouth 11 by squeezing the barrel 12 of the outer layer body 2. When the outer layer body 2 is restored to its original shape after the contents are dispensed, the ambient air flows from the ambient air introduction hole 14 described later into between the outer layer body 2 and the inner layer body 3, and thus the outer layer body 2 can be restored to its original shape with the space S of the inner layer body 3 deformed to undergo volume reduction. Therefore, the ambient air is prevented from flowing from the mouth 11 into the space S of the inner layer body 3 after the contents are dispensed. In this manner, the contents contained in the space S is inhibited from coming in contact with the air and deterioration and change in quality thereof can be prevented.

It is to be noted that, as a spout tool, a pump may be fitted to the mouth 11. Alternately, a spout tool having the other configuration such as a spout cap configured to dispense the contents contained in the space S of the inner layer body 3 from the mouth 11 using its own weight by tilting the outer layer body 2 may be fitted to the mouth 11.

The mouth 11 is provided with a fitting protrusion 11*a* configured to fit a spout tool to the mouth 11 by plugging. The fitting protrusion 11*a* is adapted for undercut engagement with a fitting groove provided on an inner periphery of a fitting tube of the spout tool, and thus the spout tool can be fitted to the mouth 11. In a planar view, the fitting protrusions 11*a* are formed into a pair of circular arcs having an intermittent portion at two positions opposed to each other across the central axis line O of the delamination container 1 or the mouth 11.

A pair of ambient air introduction holes 14 is provided in the mouth 11 of the outer layer body 2. These ambient air introduction holes 14 are formed into a circular shape, and the central axis line of the ambient air introduction hole 14 vertically intersects with the central axis line O. A pair of ambient air introduction holes 14 respectively is disposed in the intermittent portions of the fitting protrusions 11*a* symmetrically across the central axis line O. These ambient air introduction holes 14 respectively pass through the outer layer body 2 and communicate between the outer layer body 2 and the inner layer body 3, and when the inner layer body 3 is released from the outer layer body 2, the ambient air can be introduced between the outer layer body 2 and the inner layer body 3. It is to be noted that each portion of the mouth 11 where the ambient air introduction hole 14 is provided, that is, each intermittent portion of the fitting protrusion 11*a*, is chamfered flat. Further, it is preferable that each ambient air introduction hole 14 is provided in a circumferential position that is displaced from the adhesive band 4 by over 90° or more. In this example, each of the two ambient air introduction holes 14 is provided in a circumferential position that is displaced from the adhesive band 4 by 90°.

Below the mouth 11 (in this example, the lower end of the mouth 11) is provided with a neck ring 15. The neck ring 15 protrudes radially outward from the outer periphery of the mouth 11 and forms a substantially annular protrusion extending in a circumferential direction. With the neck ring 15 provided to the mouth 11, when a spout tool such as a spout cap and the like is fitted to the mouth 11 by plugging, a fitting tool for plugging can be fitted to the neck ring 15.

Figure 5:
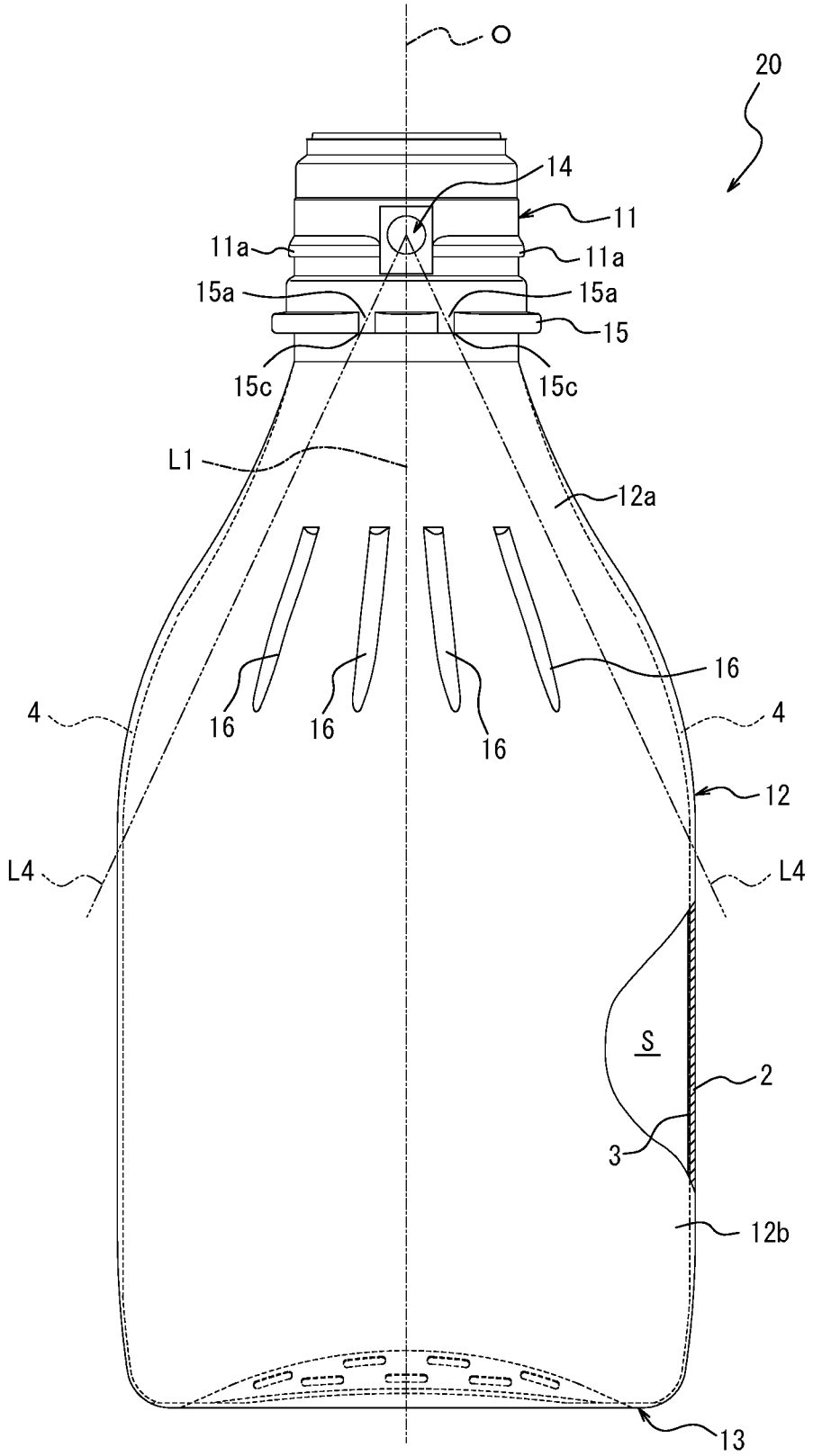
FIG. 5 is a side view of a delamination container according to the other embodiment of the present disclosure.
Figure 6:
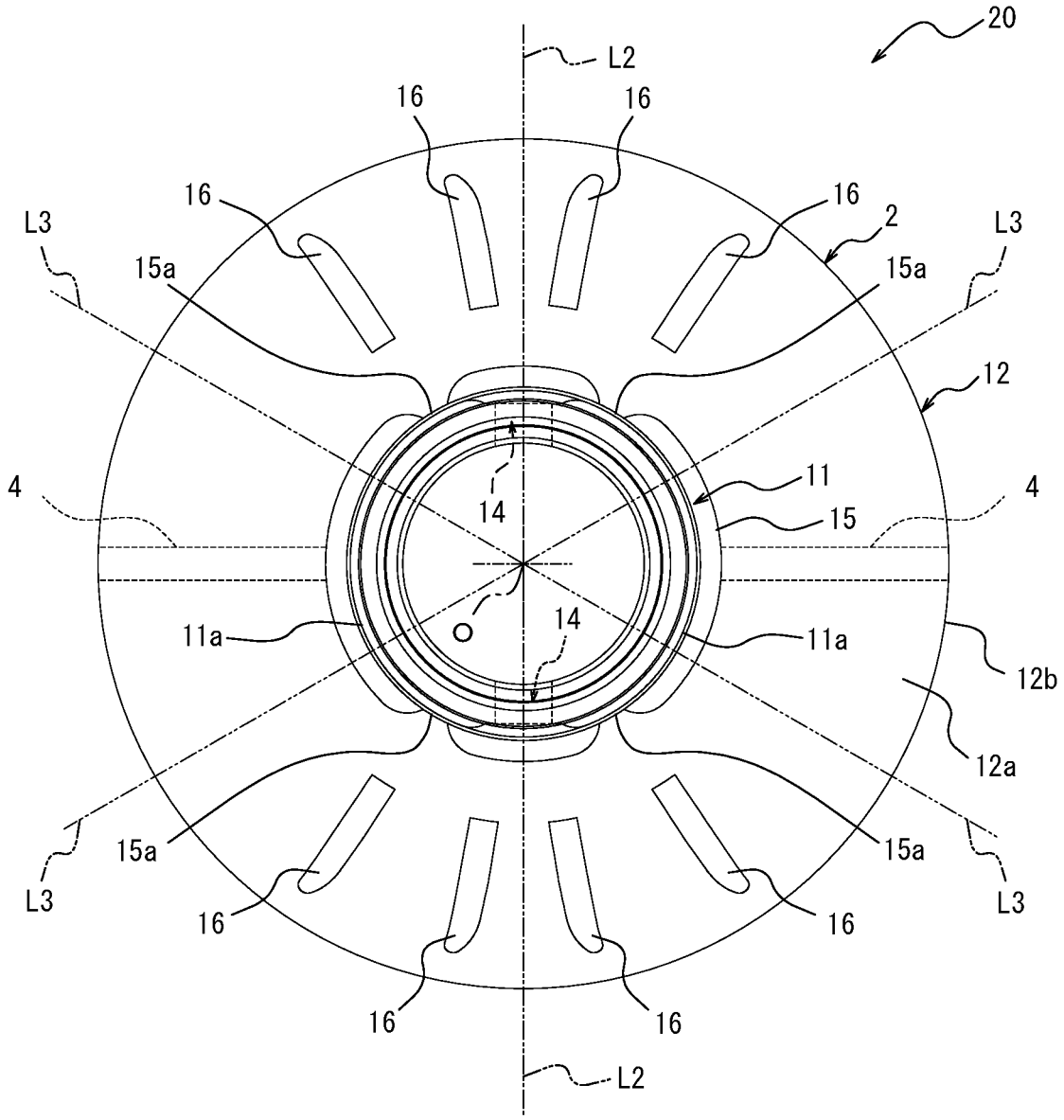
FIG. 6 is a plan view of the delamination container illustrated in FIG. 5.

The neck ring 15 has a notch 15*a* on the circumferentially outside of at least a portion immediately below the ambient air introduction hole 14. In this example, a circumferentially long notch 15*a* that extends circumferentially outward of the portion immediately below the ambient air introduction hole 14 is provided. It is to be noted that, as illustrated in FIGS. 5 and 6, a pair of notches 15*a* located on both sides across the up and down reference line L1 (illustrated as the same line as the central axis line O in FIG. 1) passing through the axial center of the ambient air introduction hole 14 and extending in the up and down direction may be provided.

In this context, a substantially annular recess 15*b* (see FIG. 3B) corresponding to the neck ring 15 is provided on the inner surface of the mouth 11 to which the neck ring 15 is provided. When the recess 15*b* is too deep, the releasability of the inner layer body 3 with respect to the outer layer body 2 may be deteriorated. Thus it is preferable that the depth of the recess 15*b* is as small as possible. In the present embodiment, the neck ring 15 is provided with the notch 15*a* that is recessed radially inward from the outer surface, and as a result the depth of the recess 15*b* is decreased on the inner surface side of the notch 15*a*. In this manner the releasability of the inner layer body 3 with respect to the outer layer body 2 can be improved. That is, in the region of the notch 15*a*, during the initial release processing and the use of a container, the inner layer body 3 is easily released from the outer layer body 2, and an introduction channel of the ambient air introduced from the ambient air introduction hole 14 can be easily formed.

It is to be noted that the inventor's study shows that the ambient air introduced from the ambient air introduction hole 14 flows downward in a radially expanding manner from the ambient air introduction hole 14. Thus, the notch 15*a* is provided circumferentially outside of at least a portion immediately below the ambient air introduction hole 14 so that the air introduced from the ambient air introduction hole 14 can easily expand downward in a radial manner. In this manner, the ambient air introduction efficiency can be increased.

Figure 2:
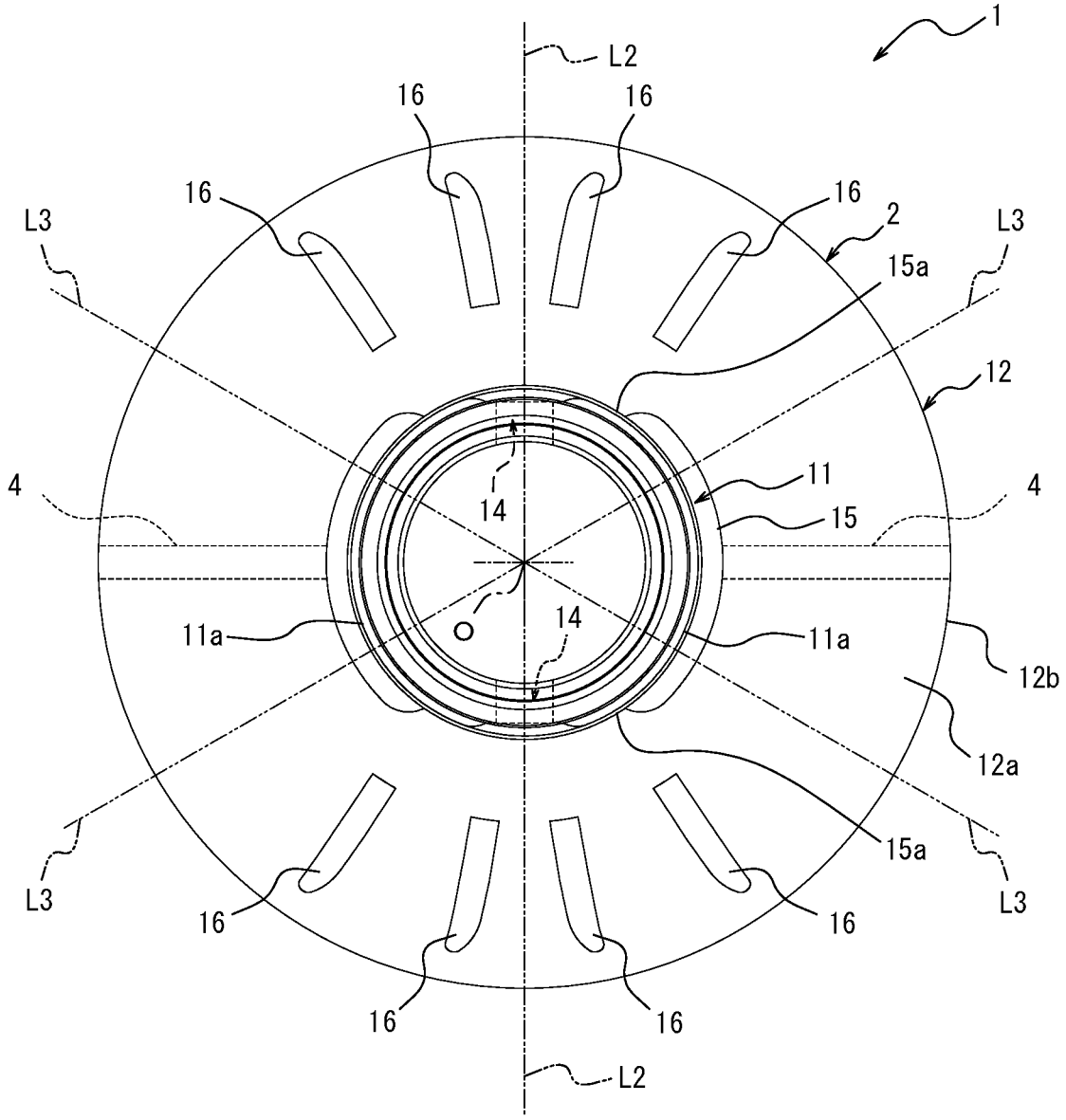
FIG. 2 is a plan view of the delamination container illustrated in FIG. 1.

As illustrated in a plan view of FIG. 2, in the present embodiment, each of the ambient air introduction holes 14 opposed to each other is provided with its corresponding notch 15*a*. That is, two notches 15*a* in total are provided. Each notch 15*a* is disposed at a position circumferentially displaced with respect to the extension line of the adhesive band 4. In this manner the releasability of the inner layer body 3 from the outer layer body 2 can be more reliably improved at a portion where the notch 15*a* is provided. The notches 15*a* are disposed respectively within a range of 60° (illustrated by a chain double-dashed line L3) on both sides of a radial reference line L2 passing through the axial center of the ambient air introduction hole 14 and extending in the radial direction. When the size of each notch 15*a* is increased over the above described range, the circumferential length of the neck ring 15 is decreased and a range of supporting the neck ring 15 from under thereof during plugging, transportation or the like is decreased, and as a result the functionality may be decreased. Further, when the circumferential length of the neck ring 15 is decreased, overall strength of the neck ring 15 is decreased. Thus, the ranges of notches 15*a* on both sides of the radial reference line L2 are determined respectively to be within 60°, and as a result such a decline in the functionality of the neck ring 15 can be suppressed. Further, when each notch 15*a* is determined to be within the above described range, the ambient air introduction channel for introducing the ambient air from the ambient air introduction hole 14 is provided at an appropriate position, and as a result the ambient air introduction efficiency can be increased.

As illustrated in FIG. 1, below one of the ambient air introduction holes 14 of the barrel 12 is provided with two piece of longitudinal ribs 16 on each of both sides across the up and down reference line L1 (four pieces of longitudinal ribs 16 in total). That is, in this example, a pair of longitudinal ribs 16 is provided below each of the notches 15*a*. Further, below the other ambient air introduction hole 14 of the barrel 12 is also provided with four pieces of longitudinal ribs 16 in the same manner. That is, in the present embodiment, four pieces of longitudinal ribs 16 are provided on both sides across the central axis line O of the barrel 12, respectively. These eight pieces of longitudinal ribs 16 in total are provided respectively on the shoulder 12*a* of the barrel 12, and are disposed symmetrically on right and left sides across the above described up and down reference line L1. The upper ends of the longitudinal ribs 16 are respectively disposed spaced apart from the upper end of the barrel 12 in the up and down direction. That is, the upper end of each longitudinal rib 16 is disposed spaced apart also from the neck ring 15 in the up and down direction.

Figure 3A:
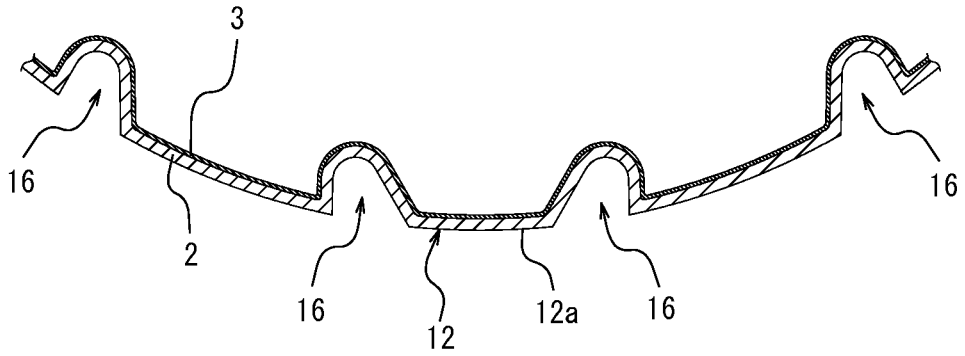
FIG. 3A is a cross-sectional view along line A-A in FIG. 1.
Figure 3B:
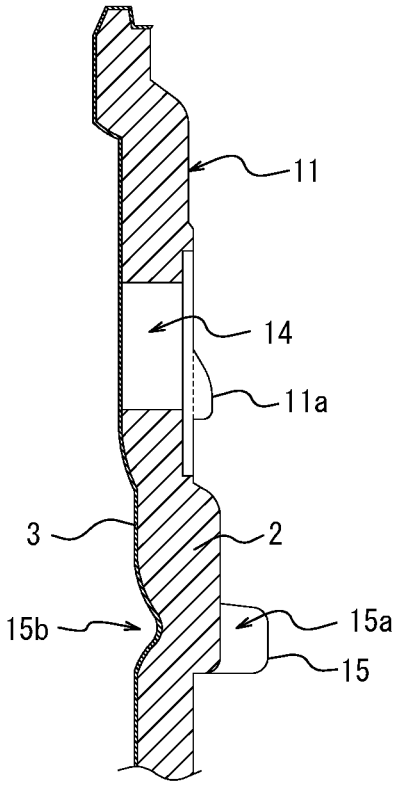
FIG. 3B is a cross-sectional view along line B-B in FIG. 1.
Figure 4A:
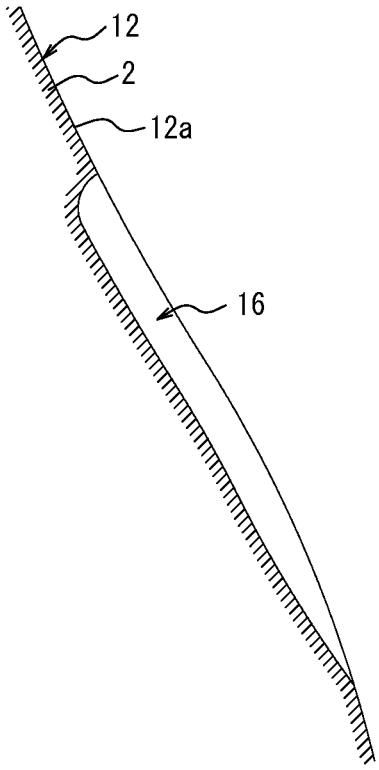
FIG. 4A is a cross-sectional view along line C-C in FIG. 1.

As is obvious from the cross-sectional views illustrated in FIGS. 3A and 4A, each of these longitudinal ribs 16 extends in the up and down direction and is formed into a recessed rib dented inward of the container. Further, on each portion provided with the longitudinal rib 16, both of the outer layer body 2 and the inner layer body 3 are dented into a recessed rib. It is to be noted that these four longitudinal ribs 16 have the same length, and the positions thereof in the up and down direction are also the same.

Figure 4B:
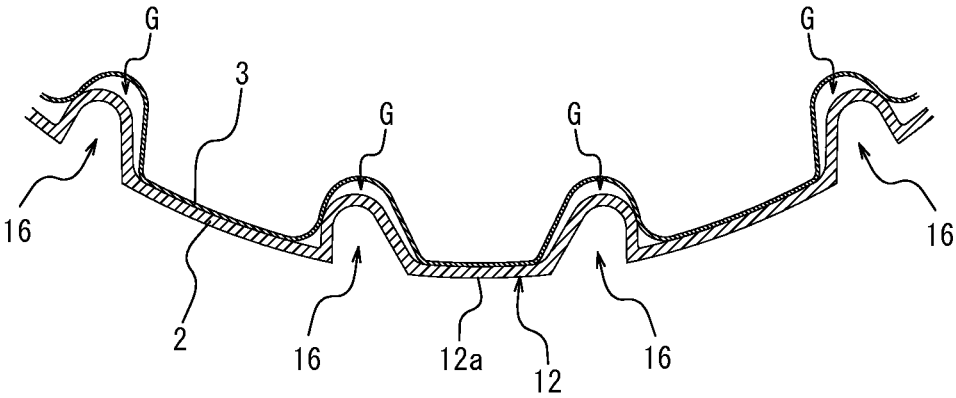
FIG. 4B is a cross-sectional view of a portion corresponding to FIG. 3A, illustrating a state of an inner layer body with respect to an outer layer body after an initial releasing.

In this manner, the barrel 12 is provided with the longitudinal ribs 16. Thus, after the initial release processing of the inner layer body 3 is performed, while a large part of the inner layer body 3 is again adhered to the inner surface of the outer layer body 2, and as illustrated in FIG. 4B, as for the portions on the barrel 12 where the longitudinal ribs 16 are provided, a gap G can be generated between the outer layer body 2 and the inner layer body 3 without adhering them. That is, the delamination container 1 that has been subjected to the initial release processing is provided with a gap G between the outer layer body 2 and the inner layer body 3 at portions of the barrel 12 where the longitudinal ribs 16 are provided.

More specifically, for example, after the delamination container 1 is formed by blow molding, the air inside the inner layer body 3 is sucked from the mouth 11, or the air is blew from the ambient air introduction hole 14 into a space between the outer layer body 2 and the inner layer body 3 to once release the inner layer body 3 from the outer layer body 2. Subsequently the air is supplied from the mouth 11 into the inner layer body 3 to restore the inner layer body 3 into its original state in which it is laminated onto the outer layer body 2. In this manner the initial release processing of the inner layer body 3 can be performed. In the initial release processing, the inner layer body 3 once released from the outer layer body 2 is laminated again on the inner surface of the outer layer body 2, and at that time, displacement occurs between the portion of the outer layer body 2 where the longitudinal rib 16 is provided and the portion of the inner layer body 3 where the longitudinal rib 16 is provided, which makes it difficult for the inner layer body 3 to adhere to the inner surface of the outer layer body 2. As a result a gap G as illustrated in FIG. 4B is generated between the outer layer body 2 and the inner layer body 3. In this manner, in the initial release processing, it becomes difficult for the inner layer body 3 to adhere to the outer layer body 2, and a gap G can be reliably generated at a portion of the barrel 12 where the longitudinal rib 16 is provided.

In this context, it is preferable that, viewed from the axial direction of the ambient air introduction hole 14, the longitudinal rib 16 is provided at a position avoiding a virtual line L4 passing through the axial center of the ambient air introduction hole 14 and the end 15*c* of the notch 15*a* farthest away from the up and down reference line L1, as illustrated in FIG. 1. In this manner, the ambient air introduced from the ambient air introduction hole 14 along the virtual line L4 flows smoothly toward the bottom 13 without being interrupted by the longitudinal rib 16, and as a result the ambient air introduction efficiency can be further increased. It is to be noted that the end 15*c* of the notch 15*a* farthest away from the up and down reference line L1 means an end 15*c* of each notch 15*a* corresponding to each ambient air introduction hole 14 farthest away from the up and down reference line L1, and an end of each notch 15*a* provided opposed to each other across the central axis line O with respect to the ambient air introduction hole 14 is not included.

Moreover, it is preferable that the longitudinal rib 16 is provided inside a pair of virtual lines L4 located on both sides of the up and down reference line L1, which allows an ambient air introduction channel to be easily formed along the virtual line L4 in the region outside the longitudinal rib 16, and as a result the ambient air introduction efficiency can be further increased.

It is to be noted that the longitudinal rib 16 is not an essential component. The number, the position and the length of the longitudinal rib 16 are not limited, and may be changed appropriately. Further, an additional longitudinal rib may be provided above, below or both above and below the four pieces of longitudinal ribs 16 illustrated in FIG. 1.

In the delamination container 1 configured in the above described manner, the neck ring 15 is provided with the notch 15*a* that extends circumferentially outward of the range immediately below the ambient air introduction hole 14 to allow the inner layer body 3 to be easily released from the outer layer body 2 at the portion where the notch 15*a* is provided. In this manner the ambient air can be reliably introduced from the ambient air introduction hole 14 to the barrel 12 side. Further, in the present embodiment, a pair of longitudinal ribs 16 is provided on both sides below each notch 15*a*. Thus, a gap extending from each notch 15*a* to respective longitudinal ribs 16 is generated between the outer layer body 2 and the inner layer body 3. In this manner, the ambient air sucked from the ambient air introduction hole 14 into between the outer layer body 2 and the inner layer body 3 when the outer layer body 2 is restored to its original shape can be reliably flowed to the bottom 13 through the ambient air introduction channel formed by a gap G at each longitudinal rib 16.

In this manner, when the barrel 12 is provided with the longitudinal rib 16, a gap G is generated, after the initial release processing of the inner layer body 3, at each portion of the barrel 12 where the longitudinal rib 16 is provided. As a result the inner layer body 3 can be easily released from the outer layer body 2 at that portion. Therefore, when the outer layer body 2 is restored to its original shape after the contents are dispensed by squeezing the outer layer body 2, the inner layer body 3 can be reliably released from the outer layer body. Further, an ambient air introduction channel extending from the ambient air introduction hole 14 toward the bottom 13 is formed by a gap G generated at a portion of the barrel 12 where each longitudinal rib 16 is provided. Thus, the inner layer body 3 is reliably released from the outer layer body 2 from its bottom 13 toward the barrel 12 side when the outer layer body 2 is restored to its original shape after the contents are dispensed. In this manner the ambient air can be reliably prevented from being introduced into the space S of the inner layer body 3. Further, when the inner layer body 3 is easily released from the outer layer body 2, the squeezed outer layer body 2 can be reliably restored to its original shape. In this manner deformation of the outer layer body 2 can also be prevented.

The other embodiment of the present disclosure will be described below with reference to FIGS. 5 and 6. It is to be noted that the parts that have basically the same function as those described in the above described embodiment are assigned with the same reference signs and the explanations thereof are omitted.

As illustrated in FIGS. 5 and 6, a delamination container 20 according to the present embodiment is provided with a pair of notches 15*a* on both sides across the up and down reference line L1 below each ambient air introduction hole 14. That is, a neck ring 15 is provided between a pair of notches 15*a*. In this manner, since a neck ring 15 is provided between a pair of notches 15*a*, when compared with the above described embodiment, the circumferential range where the neck ring 15 is present is increased, and as a result the overall strength of the neck ring 15 is increased. In this manner, a possibility of a failure caused by subduction of the neck ring 15 during plugging can be reduced. Further, since the supporting range of the neck ring 15 from under the neck ring 15 is increased, a possibility of a fall caused during transportation and the like is decreased. Thus a variety of types of supporting jigs (also referred to as a neck support) can be used.

Further, in this example, a pair of notches 15*a* is disposed symmetrically across the up and down reference line L1. In this example, although a pair of notches 15*a* is provided with respect to an ambient air introduction hole 14, either one of notches 15*a* may be provided with respect to an ambient air introduction hole 14. That is, only one notch 15*a* may be provided.

As illustrated in a plan view in FIG. 6, in the present embodiment, a pair of notches 15*a* is provided to each of two ambient air introduction holes 14 opposed to each other. That is, a notch 15*a* is provided at four portions in total. It is to be noted that a notch 15*a* may be provided only to either one of the two ambient air introduction holes 14. Each notch 15*a* is provided on circumferentially outside of at least the portion immediately below the ambient air introduction hole 14 and within a range of 60° from the radial reference line L2. In this manner, a pair of notches 15*a* is provided with respect to an ambient air introduction hole 14 in an appropriate range across the up and down reference line L1, which makes it easy to flow the ambient air introduced from the ambient air introduction hole 14 radially downward, and as a result the ambient air introduction efficiency can be increased.

In this context, it is preferable that each notch 15*a* is provided at circumferential position 30° from the radial reference line L2, which allows for not only an increase in the ambient air introduction efficiency but also allows for adaptation to a support jig and the like that supports at each position 45° from the radial reference line L2 on both sides, for example.

Further, a notch 15*a* may be provided at a portion or three or more portions with respect to an ambient air introduction hole 14. When too many notches 15*a* are provided, the strength of the neck ring 15 is decreased, and the functionality thereof may be impaired. Thus, it is preferable that two notches 15*a* may be provided with respect to an ambient air introduction hole 14 (one for each of both sides across the up and down reference line L1).

The present disclosure is not limited to the above described embodiments, and it goes without saying that various changes may be made without departing from the scope of the present disclosure. For example, a longitudinal rib 16 may be provided not only in the range of the shoulder 12*a* of the barrel 12, but also in the range continuing to the barrel body 12*b*.

Further, the shape of the longitudinal rib 16 is not limited to a recessed rib dented toward the inside of the container, but also may be formed into a protruded rib protruded toward the outside of the container. In this case, some of longitudinal ribs 16 may be formed into a recessed rib and the other longitudinal ribs 16 may be formed into a protruded rib, or a recessed rib and a protruded rib may be alternately disposed. In this manner, the shape and the configuration of the barrel 12 of a portion where a longitudinal rib 16 is provided can be further complicated. As a result, in the initial release processing, it will be more difficult for the inner layer body 3 to adhere to the outer layer body 2, and a gap G can be generated more reliably at the portion of the barrel 12 where a longitudinal rib 16 is provided.

Furthermore, as the delamination containers 1 and 20, those having a mouth 11, a barrel 12 and a bottom 13 each formed into a circular shape in a planar view are illustrated. However, the mouth 11, the barrel 12 and the bottom 13 of the delamination containers 1 and 20 may have an oval or the other shapes in a planar view.

Moreover, instead of a fitting protrusion 11*a*, a screw portion is provided to the mouth 11, and a spout tool may be fitted to the mouth 11 through screw connection.

REFERENCE SIGNS LIST

1, 20 delamination container
2 outer layer body
3 inner layer body
4 adhesive band
11 mouth
11*a* fitting protrusion
12 barrel
12*a* shoulder
12*b* barrel body
13 bottom
14 ambient air introduction hole
15 neck ring
15*a* notch
15*b* recess
15*c* end
16 longitudinal rib
S space
O central axis line
La up and down reference line
L2 radial reference line

The invention claimed is:

1. A delamination container comprising:

a bottle-shaped outer layer body including a tubular mouth, a barrel extending to the mouth and a bottom extending to the barrel; and an inner layer body configured to be deformed to undergo volume reduction, the inner layer body being releasably laminated on an inner surface of the outer layer body and formed into a shape corresponding to the outer layer body; wherein:

the mouth includes:

an ambient air introduction hole passing through the outer layer body and extending between the outer layer body and the inner layer body; and a neck ring disposed on a lower portion of the mouth;

the neck ring includes a pair of notches that are respectively located on first and second sides of an axial reference line extending in a longitudinal direction of the container through an axial center of the ambient air introduction hole;

each of the pair of notches are respectively located within a range of 60° from a radial reference line passing through the axial center of the ambient air introduction hole and extending in a radial direction of the container, the radial direction being orthogonal to the longitudinal direction; and the pair of notches are separated from each other in a circumferential direction by a portion of the neck ring that is positioned so as to be axially aligned with the ambient air introduction hole in the longitudinal direction.

2. The delamination container according to claim 1, wherein the barrel includes at least one longitudinal rib provided below the ambient air introduction hole.

3. The delamination container according to claim 2, wherein the at least one longitudinal rib is provided at a position avoiding a virtual line passing through the axial center of the ambient air introduction hole and a first end of the neck ring that defines a side of a first notch of the pair of notches that is farthest away from the axial reference line.

4. The delamination container according to claim 3, wherein the at least one longitudinal rib is provided inside an area of the barrel that is defined by the virtual line and a second virtual line that passes through the axial center of the ambient air introduction hole and a second end of the neck ring that defines a side of a second notch of the pair of notches that is farthest away from the axial reference line.

5. The delamination container according to claim 4, wherein the barrel has a longitudinal adhesive band provided between the outer layer body and the inner layer body; and the pair of notches are provided at positions that are circumferentially displaced with respect to an extension line of the adhesive band.

6. The delamination container according to claim 3, wherein the barrel has a longitudinal adhesive band provided between the outer layer body and the inner layer body; and the pair of notches are provided at positions that are circumferentially displaced with respect to an extension line of the adhesive band.

7. The delamination container according to claim 2, wherein the barrel has a longitudinal adhesive band provided between the outer layer body and the inner layer body; and the pair of notches are provided at positions that are circumferentially displaced with respect to an extension line of the adhesive band.

8. The delamination container according to claim 1, wherein the barrel includes at least two longitudinal ribs provided below the ambient air introduction hole on both sides of the axial reference line.

9. The delamination container according to claim 8, wherein the at least two longitudinal ribs are provided at positions avoiding a virtual line passing through the axial center of the ambient air introduction hole and a first end of the neck ring that defines a side of a first notch of the pair of notches that is farthest away from the axial reference line.

10. The delamination container according to claim 9, wherein the at least two longitudinal ribs are provided inside an area of the barrel that is defined by the virtual line and a second virtual line that passes through the axial center of the ambient air introduction hole and a second end of the neck ring that defines a side of a second notch of the pair of notches that is farthest away from the axial reference line.

11. The delamination container according to claim 10, wherein the barrel has a longitudinal adhesive band provided between the outer layer body and the inner layer body; and the pair of notches are provided at positions that are circumferentially displaced with respect to an extension line of the adhesive band.

12. The delamination container according to claim 9, wherein the barrel has a longitudinal adhesive band provided between the outer layer body and the inner layer body; and the pair of notches are provided at positions that are circumferentially displaced with respect to an extension line of the adhesive band.

13. The delamination container according to claim 8, wherein the barrel has a longitudinal adhesive band provided between the outer layer body and the inner layer body; and the pair of notches are provided at positions that are circumferentially displaced with respect to an extension line of the adhesive band.

14. The delamination container according to claim 1, wherein the barrel has a longitudinal adhesive band provided between the outer layer body and the inner layer body; and the pair of notches are provided at positions that are circumferentially displaced with respect to an extension line of the adhesive band.

* * * * *